United States Patent [19]

Manabe et al.

[11] Patent Number: 5,061,198

[45] Date of Patent: Oct. 29, 1991

[54] ELECTRICAL CONNECTOR SYSTEM

[75] Inventors: Sakae Manabe; Hirosumi Kanai, both of Kawasaki, Japan

[73] Assignee: AMP Incorporated, Harrisburg, Pa.

[21] Appl. No.: 686,862

[22] Filed: Apr. 15, 1991

Related U.S. Application Data

[63] Continuation of Ser. No. 540,677, Jun. 15, 1990, abandoned.

[30] Foreign Application Priority Data

Jun. 15, 1989 [JP] Japan ..... 1-69928[U]
Oct. 11, 1989 [JP] Japan ..... 1-118348[U]

[51] Int. Cl.[5] ..... H01R 13/28
[52] U.S. Cl. ..... 439/293; 439/397
[58] Field of Search ..... 439/287, 292, 293, 354, 439/623, 624, 694, 723, 724, 739, 865, 868, 395, 397, 399, 407, 443

[56] References Cited

U.S. PATENT DOCUMENTS 3,656,085 4/1972 Holiday ..... 339/91 R
4,330,164 5/1982 Pittman et al. ..... 439/293
4,820,179 4/1989 Saijo ..... 439/397

FOREIGN PATENT DOCUMENTS 0240454 3/1987 European Pat. Off. .
0330497 2/1989 European Pat. Off. .
8303717 10/1983 PCT Int'l Appl. .
2122036 4/1983 United Kingdom .

*Primary Examiner*—Paula A. Bradley
*Attorney, Agent, or Firm*—Adrian J. LaRue; Allan B. Osborne

[57] ABSTRACT

An electrical connector system (10) comprising a pair of matable drawer connectors (**10*a*,10*b*) is disclosed. The connectors (10*a*,10*b*) are preferably identical and include contact (31) having first contact sections (32) at one end which mate with other first contact sections (32) and second contact sections (33) at another end which mate second contacts (110) carried by wiring harness connectors (100**).

2 Claims, 4 Drawing Sheets

ELECTRICAL CONNECTOR SYSTEM

This application is a continuation of application Ser. No. 07/540,677 filed June 15, 1990, now abandoned.

FIELD OF THE INVENTION

The present invention relates to a pair of matable electrical connectors for use in transferring electrical current from a non-moving or stationary part of a machine; e.g., a drawer, to a moving part; e.g., a drum or paper feeder.

BACKGROUND OF THE INVENTION

In a conventional copy machine, a pair of drawer connectors are used for electrically interconnecting immovable portion within the copy machine and a movable portion such as a drum and a paper feeder. The pair of drawer connectors are connected when the copy machine is in operation but are disconnected to interrupt the electrical connection between the immovable and movable portions when the movable portion is drawn for troubleshooting, supplying paper, etc.

Electrical connections between electrical circuits within the copy machine and the drawer connectors are typically made by individually inserting electrical contacts having electric wires from the electrical circuits crimped thereto into each cavity in the drawer connector housing. However, such assembly is poor in efficiency and may be subject to wiring errors.

It is, therefore, an object of this device to provide an electrical connector free from the above mentioned problems. This object is achieved by mating respective wiring harness connectors with an intermatable pair of drawer connectors.

SUMMARY OF THE INVENTION

In order to achieve the above object, the electrical connector according to the present device comprises a pair of drawer connectors and a plurality of wiring harness connectors.

The pair of drawer connectors have a plurality of first contacts, each comprising a first contact section extending to the mating face of the drawer connectors and a second contact section extending to the back face opposite to the mating face. The second contact sections extend into cavities in the back face. When the pair of drawer connectors are mated with each other, the first contact sections are brought into electrical contact to each other.

The wiring harness connectors comprise a plurality of second contacts arranged therein and a plurality of electrical wires electrically connected thereto. When the wire harness connectors are inserted into the respective cavities in the pair of drawer connectors, contact sections of the second contacts electrically contact the second contact sections of the first contacts.

The pair of drawer connectors are preferably identical to each other.

BRIEF DESCRIPTION OF THE DRAWINGS

An embodiment of the electrical connector according to the present device will be described hereunder by reference to the accompanying drawings in which.

DESCRIPTION OF THE INVENTION

Figure 1:
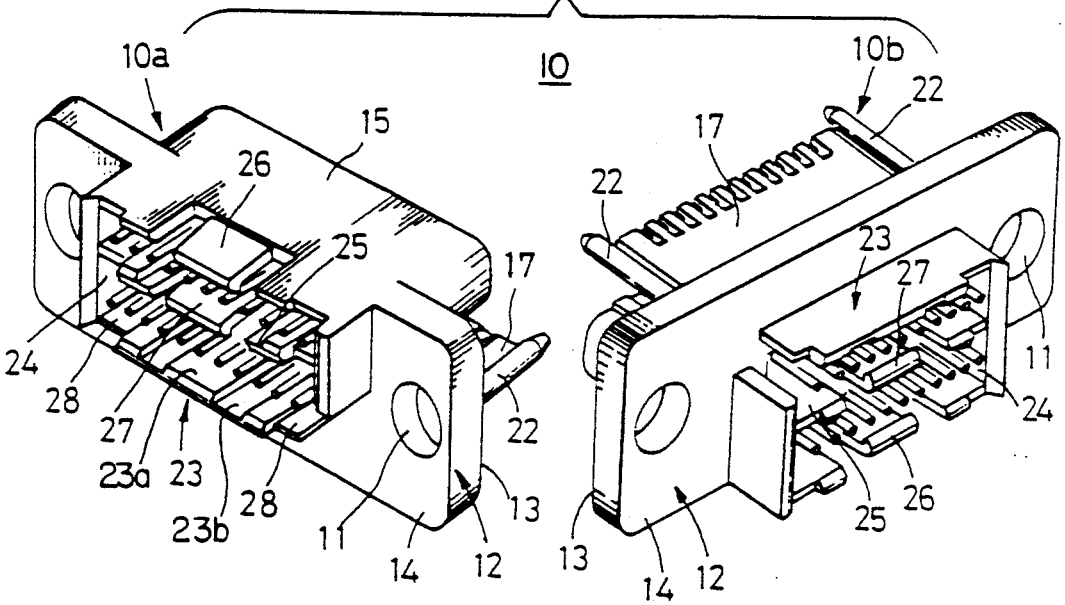
FIG. 1 is a perspective external view of one embodiment of a pair of drawer connectors constituting the electrical connector according to the present device.
Figure 2:
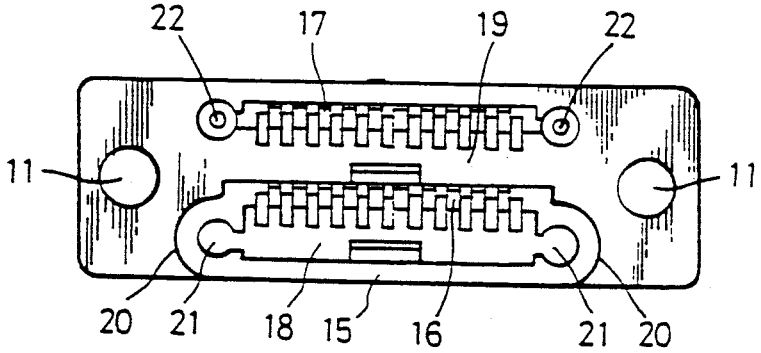
FIG. 2 is a plan view of the mating face of the drawer connector.

In FIGS. 1 and 2, a pair of drawer connectors 10*a*, 10*b* comprising electrical connector system 10 are illustrated. The connectors 10*a*, 10*b* are preferably identical to each other and are positioned symmetrically to each other. For example, the connector 10*a* is installed on an immovable part inside of a copy machine (not shown) and the connector 10*b* on a movable member such as a drum or a paper feeding tray in a form of a drawer from the copy machine. The connector 10*b* is selectively mated with or removed from the connector 10*a* by mounting it on the moving part with a mounting screw through a screw hole 11.

The connectors 10*a*, 10*b* include housings 12 made from an electrically insulating material. Provided on the mating (front) surfaces 13 of the housings 12 are isolation walls 15,16,17 extending forwardly and isolated vertically from each other. Mating grooves 18,19 are formed between the isolation walls 15–16 and 16–17, respectively. Both side edges of the isolation walls 15,16 are intercoupled with arcuate sections 20 to form guide sockets 21. There are formed guide pins 22 at both sides of the isolation walls 17 to be inserted into the guide sockets 21. An enclosing wall 23 is provided on the back face 14 of the housing 12 to form a cavity 24 to receive wiring harness connectors 100 which are described hereinafter. The cavity 24 is vertically separated into upper and lower sections by horizontally intermittent isolation walls 25. Vertically resilient latching members 26 are provided at the upper center position (for the connector 10*a*) and the lower center position (for the connector 10*b*). Also, provided at the center portion of the isolation walls 25 are vertically, resilient latching members 27. Projections 23*a* and grooves 23*b* are formed on the inner surface of the enclosing walls 23 at the lower side (for the connector 10*a*) and at the upper side (for the connector 10*b*). Surfaces 28 at both sides on the inner surface provides guide surfaces of the guide projection of the wiring harness connector 100 described hereinafter.

Figure 5:
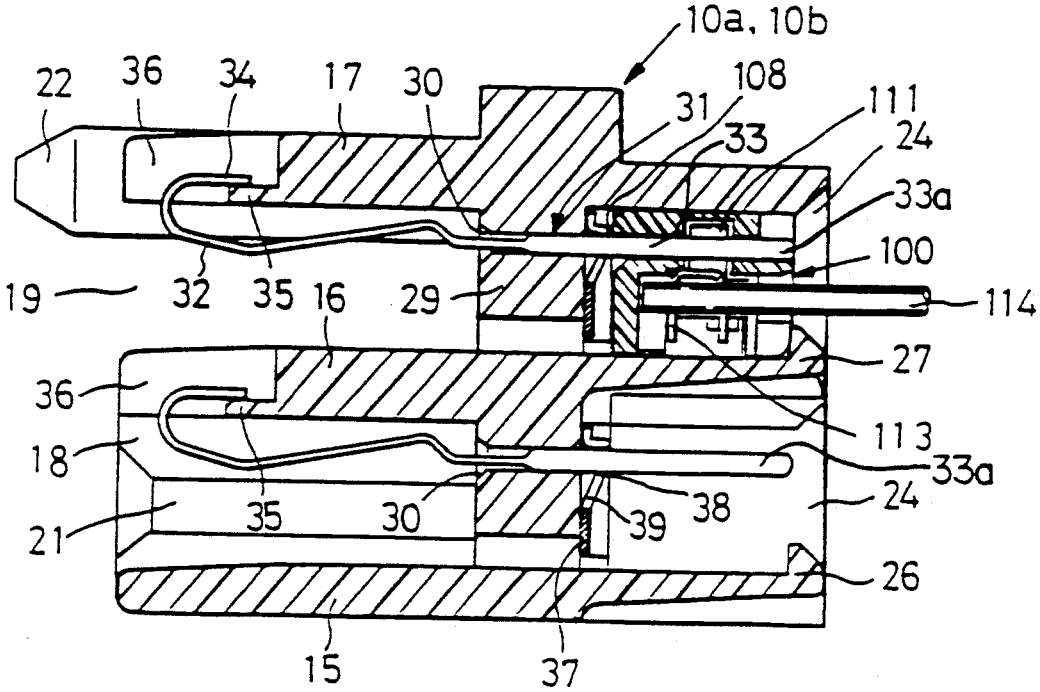
FIG. 5 is a cross section view at the center of the mated drawer connector and wiring harness connector in FIG. 4.

As illustrated in FIGS. 1 and 5, there are formed contact retention passageways 30 in wall 29 between the mating grooves 18,19, and the cavity 24 at a constant pitch in horizontal direction. Each contact 31 is made of a conductive metal and comprises a first contact section 32 bent to provide resiliency and extending into the mating groove 18,19 and a second contact section 33 having straight pin 33*a* extending into the cavity 24. The intermediate section of the contact 31 penetrates the retention passageway 30 to hold the contact 31 therein. A tongue portion 34 of the first contact section 32 engages a front step portion 35 of the isolation wall 16,17. Lateral recesses 36 are formed at the front end of the isolation wall 16,17. The above step portion 35 is formed at the front end of the recesses 36. In this way, the front end of each first contact section 32 is positioned inside of the front end of the isolation wall 16,17 for protection of the first contact section 32.

Positioned at one part on the back face of wall 29 is a conductive plate 37 in which a plurality of through-holes 38 are disposed at the pitch corresponding to the second contact sections 33 of the contacts 31. The through-holes 38 are formed by partly cutting and raising the conductive plate 37. The cut and raised leaves 39 have resiliency in the radius direction of each through-hole 38. Electrical connections between the second contact sections 33 and the contacts 31 at desired through-holes 38 at which the cut and raised leaves 39 penetrate and contact the second contact sections 33. For this reason, the conductive plate 37 is known as a commoning plate.

Figure 3:
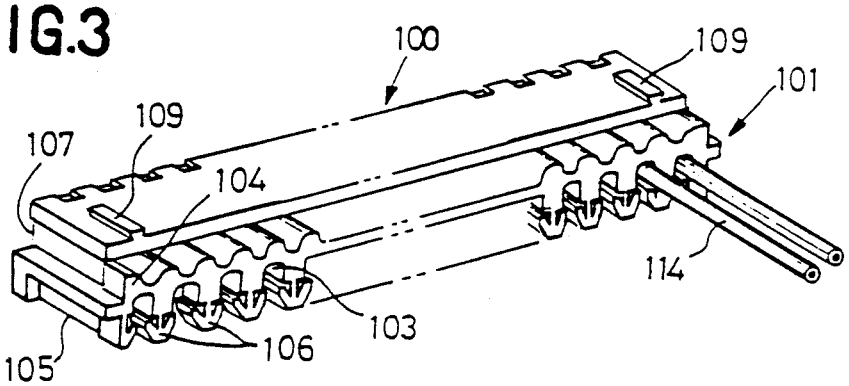
FIG. 3 is a perspective external view of one embodiment of the wiring harness connector constituting the electrical connector of the present device.

In FIG. 3 (also refer to FIG. 5), a perspective view of the wire harness connector 100 is illustrated. The connector 100 is also known as a commoning terminal connector (CT connector). The connector 100 includes a housing 101 which is made from an electrically insulating material. The housing 101 has a dimension and shape to be received in either the upper or lower cavities 24 defined by the isolation wall 25. The housing 101 has a plurality of cavities 103 laterally disposed at a predetermined pitch. Each cavity 103 opens at the back face 104 and the bottom face 105. There are formed a latching section 106, a guide opening 108 for the second contact section 33 of the contact 31, and a guide projection 109 to slide along the guide surface 28.

Figure 6:
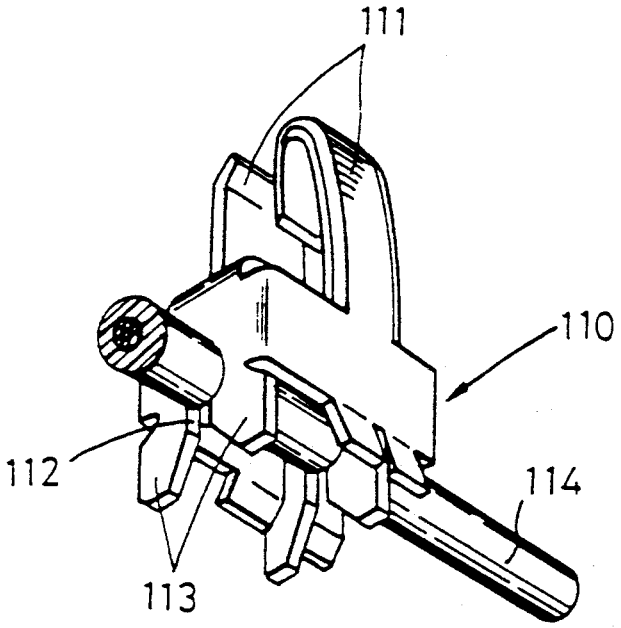
FIG. 6 is a perspective external view of the contact included in the wiring harness connector.

Illustrated in FIG. 6 is the contact 110 retained in the cavity 103 in the housing 101. The contact 101 is made of a conductive metal and comprises a resilient contact section 111 and a wire connection section 113 having a V-shaped slot 112. The drawer connectors **10*a*, 10*b* of the aforementioned construction are mated with each other by aligning the guide socket 21 and the guide pin 22 of the former with the guide pin 22 and the guide socket 21 of the latter and also aligning the isolation walls 16,!7 and the mating grooves 18,19 of the former with the mating grooves 18,19 and the isolation walls 16,17 of the latter, respectively. Under the mated condition of the connectors 10*a*, 10*b*, the contact sections 32 of the contacts 31** of the both connectors are resiliently brought into electrical contact with each other.

Figure 4:
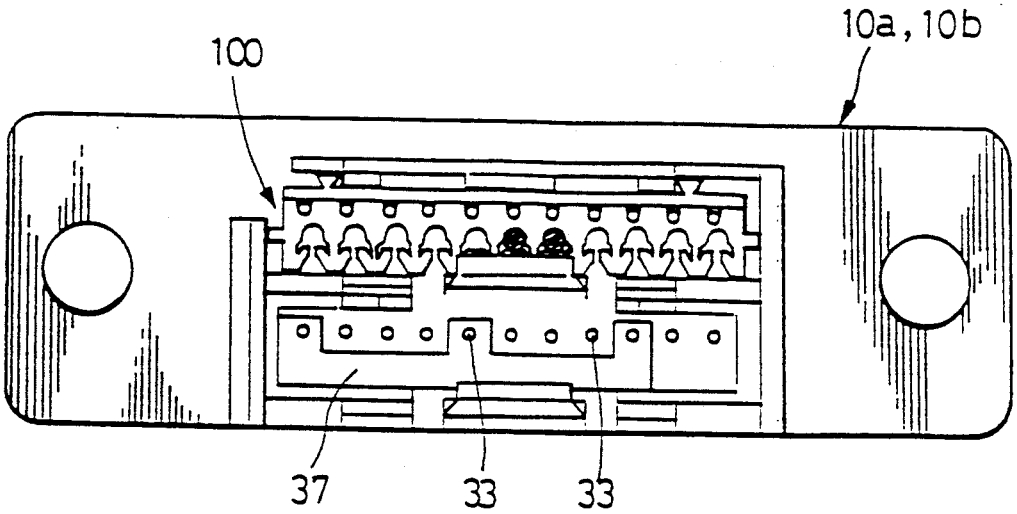
FIG. 4 is a plan view at the back face of the drawer connector having the wiring harness connector accommodated in the upper cavity of the drawer connector.

On the other hand, the wiring harness connectors 100 of the aforementioned construction are accommodated in the upper and lower cavities 24 in the back of the drawer connectors **10*a*, 10*b* as shown in FIGS. 4 and 5. It should be noted, however, that only one wire harness connector 100 is inserted in the upper cavity 24 in these figures and the wire harness connector 100 to be inserted in the lower cavity 24 is omitted. Under the mated condition, the second contact sections 33 of the contacts 31 in the drawer connectors 10*a*, 10*b* make resiliently electrical contact with the respective contact sections 111 of the contacts 110 in the wiring harness connector 100 and also the latching member 27 of the former connector 10*a* engages the back end of the latter connector 100**.

As is well known in the art a CT connector for use with crimp type contacts (not shown) may be used along with connector 100. However, such connectors may be of a different size and accordingly cannot be effectively latched using latching members 26,27. To overcome this problem an alternate latching device is shown in FIGS. 7 and 8.

Figure 7A:
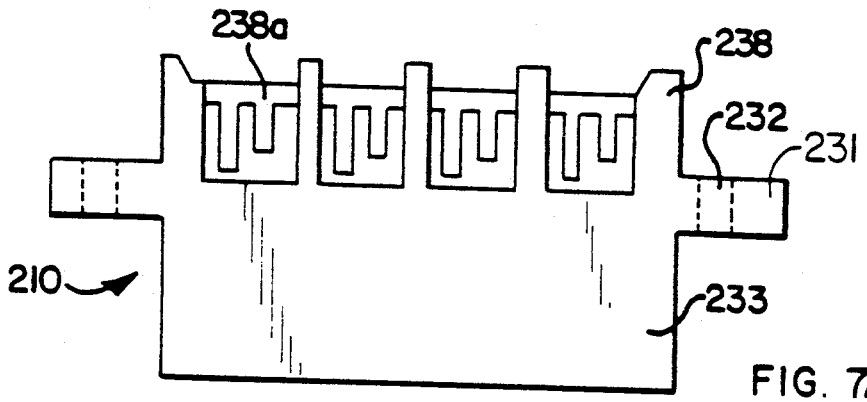
FIG. 7 (A) and (B) are respectively side and top views of another embodiment of the latch device for the electrical connector according to the present device.
Figure 7B:
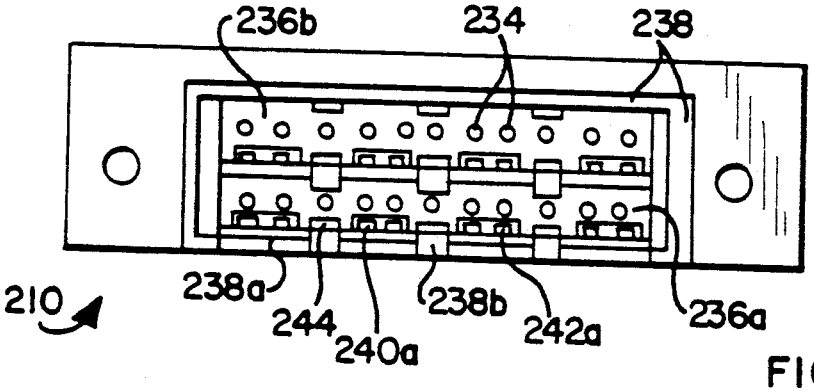

Illustrated in FIG. 7 (A) and (B) are side and back views of connector 210 respectively. Connector 210 has a housing 230 with plate-like mounting sections 231 extending to both left and right sides of a center section 233. A pair of holes 232 for mounting screws may be bored in the mounting sections 231. Wall 238 encloses a large number of contact pins 234 to be connected to a CT connector (not shown) and forms two elongated CT connector-receiving cavities **236*a*, 236*b*. The wall 238 is thinned at 4 positions to provide internal recesses 238*a* along the wall and has resilient latching arms 240, 242 of different lengths extending inwardly to provide free ends at the inner ends of the latching arms. Each latching arm 240, 242 is provided with a latching projection 240*a*, 242*a* adjacent to the free end. A stopper surface 244 is formed at the internal portion of the thick section 238*b* to restrict the depth of insertion of the CT connector to be inserted in the cavities 36*a*, 36*b***.

Figure 8:
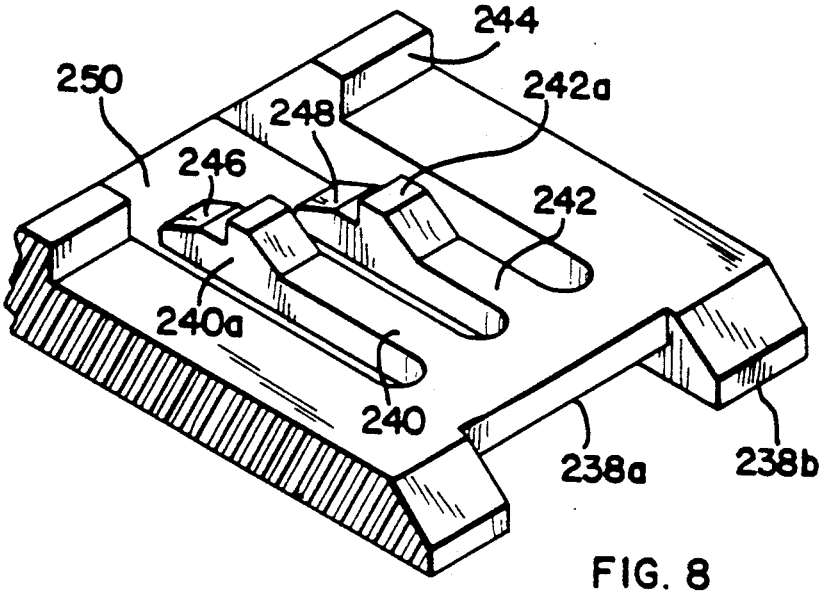
FIG. 8 is a magnified perspective view of the latch arms in FIG. 7.

Illustrated in FIG. 8 is a magnified perspective partial view of the latching arms 240, 242 formed in the wall 238 of connector 210. Thickness of each latching arm 240, 242 is chosen to have sufficient resiliency and latching strength. Each latching arm 240, 242 has near the free end thereof a cam surface sloped at an acute angle with respect to the inner surface of the wall, a flat top section and a latching surface substantially at right angles with respect to the inner surface. The free ends have tapered section 246, 248 from the inner to outer surfaces for the purpose described hereinafter. Each of a plurality of sections of the CT connector-receiving cavities **36*a*, 36*b* has a pair of latching arms 240, 242 of different lengths from each other for the following reason. Existing CT connectors slightly differ in housing construction between the insulation displacement type and crimping type. That is, the plate thickness of the front face 107 exposed at the bottom surface 105 of the insulation displacement type CT connector 100 as illustrated in FIG. 3 is as thin as less than 1 mm while the corresponding part of the crimping type CT connector (not shown) is about 2 mm. The reason of providing two latching arms 240, 242 in the present embodiment is to provide free insertion and latching such CT connectors of different housing construction. Such arrangement enables one to insert either insulation displacement or crimping type CT connector into any desired section in the connector-receiving cavity. For example, an insulation displacement type CT connector and a crimping type CT connector may be inserted into the left 3 sections and the extremely right section in the connector-receiving cavity 36*a***, respectively.

The insulation displacement type CT connector 100 is latched by more than one longer latching arms 240 while the adjacent shorter latching arms 242 do not contribute to latching action and do not disturb its operation. On the other hand, in case of inserting the crimping type CT connector, the shorter latching arm (or arms) 242 provides latching. The longer latching arm (or arms) 240 is deflected outwardly by the outer wall of the CT connector housing and does not contribute to latching action. However, the outer wall **238*a* at this section is retarded backwardly from the outer wall at the other section (for example the outer wall of the housing 230 including the wall section 238***b*). Therefore, the free ends of the latching arms 240 do not extend from the outer wall and, thus, causes no problem in practical use or in appearance.

The CT connector is seldom removed if once inserted into the connector-receiving cavity 236*a*, 236*b*. However, there is an instance that the CT connector is required to be pulled out, for example, when the CT connector is inserted into incorrect position or when the insertion position is later modified. It is, of course, uneconomical to dispose the entire connector when a defect is found in a contact or electric wire of the CT connector. In this case, opening 250 is formed adjacent to the free ends of the latching arms 240, 242 in the connector-receiving cavity 236*a*, 236*b*. A comb-like tool (not shown) may be inserted in the opening 250 in contact with the tapered section 246, 248 at the free ends of the latching arms 240, 242. This deflects the latching arms 240, 242 outwardly, thereby allowing the inserted CT connector to be pulled out.

As can be discerned, an electrical connector system has been disclosed which improves the workability over that of conventional connectors. The connector system includes matable connectors which are preferably identical and which includes contacts having one end adapted to engage like contacts when the two connectors are mated. The contacts have second ends which are adapted to receive contacts carried by a CT connector. Further, latching members which are adapted to accept different size CT connectors have been disclosed.

We claim:

1. An electrical connector, comprising:

a dielectric housing having a front section and a back section, said back section having cavities;

electrical contacts secured in said housing having first contact sections disposed in said front section and second contact sections extending into said cavities so that matable electrical connectors having matable electrical contacts can be inserted into said cavities with the matable electrical contacts being electrically connected with the second contact sections; and side-by-side latching members in the form of long latching members and short latching members on said housing extending inwardly from a rear surface of said back section within said cavities for latchable engagement with the matable electrical connectors thereby latching them in said cavities.

2. The electrical connector of claim 1 wherein said electrical contacts include a resilient contact section and a wire displacement section.

* * * * *